US006787963B2

(12) United States Patent
Tanaka et al.

(10) Patent No.: US 6,787,963 B2
(45) Date of Patent: Sep. 7, 2004

(54) BRUSH ASSEMBLY

(75) Inventors: Toshinori Tanaka, Tokyo (JP); Keiichi Fukazawa, Tokyo (JP); Kei Yonemori, Tokyo (JP); Yusuke Matsui, Tokyo (JP); Kyouhei Yamamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 52 days.

(21) Appl. No.: 09/993,686

(22) Filed: Nov. 27, 2001

(65) Prior Publication Data

US 2002/0167244 A1 Nov. 14, 2002

(30) Foreign Application Priority Data

May 10, 2001 (JP) ..... 2001-139731

(51) Int. Cl.[7] ..... H01R 39/18

(52) U.S. Cl. ..... 310/248; 310/249; 310/251; 310/252; 310/253

(58) Field of Search ..... 310/248–253, 310/42–45; 29/826

(56) References Cited

U.S. PATENT DOCUMENTS 1,093,614 A * 4/1914 Gilson ..... 252/503
1,629,875 A * 5/1927 Kerlin et al. ..... 310/249
3,590,300 A * 6/1971 Moberly ..... 310/248
5,414,319 A * 5/1995 Nowicki et al. ..... 310/248
5,909,077 A * 6/1999 Bruhn ..... 310/251
6,011,342 A * 1/2000 Walther ..... 310/244
6,552,466 B2 * 4/2003 Schwabbauer et al. ..... 310/248

FOREIGN PATENT DOCUMENTS

| | | | |
|---|---|---|---|
| JP | 178682 | B | 12/1923 |
| JP | 35-015156 | B | 10/1935 |
| JP | 55-10915 | | 8/1980 |
| JP | 57-146775 | U | 9/1982 |
| JP | 59-069490 | U | 5/1984 |
| JP | 04-500580 | A | 1/1992 |
| JP | 6-133500 | | 5/1994 |
| JP | 06-133500 | A | 5/1994 |
| JP | 06-303742 | A | 10/1994 |
| JP | 07-184356 | A | 7/1995 |
| JP | 2000-004562 | A | 1/2000 |
| JP | 2000-048927 | A | 2/2000 |

* cited by examiner

*Primary Examiner*—Dang Le
(74) *Attorney, Agent, or Firm*—Sughrue Mion, PLLC

(57) ABSTRACT

An brush assembly is provided in which electric power losses in brushes 32 are reduced, thereby suppressing an abnormal or excessive rise in temperature of the brushes. A tip end of a lead wire 33 inserted into a corresponding brush 32 in a direction of pressing upon press molding thereof is embedded in the brush in such a manner that it extends over two thirds or more of the length in the pressing direction of the brush 32.

7 Claims, 7 Drawing Sheets

BRUSH ASSEMBLY

This application is based on Application No. 2001-139731, filed in Japan on May 10, 2001, the contents of which are hereby incorporated by reference.

BACKGROUND OF THE INVENTION

1. Field of the Invention

The present invention relates to a brush assembly incorporated in a motorized power steering apparatus for example.

2. Description of the Related Art

FIG. 6 is a cross sectional side view of a known motorized power steering apparatus, and FIG. 7 is a front elevation of a brush assembly 40 incorporated in the motorized power steering apparatus.

This motorized power steering apparatus includes an electric motor 30 for generating a rotating force or torque and an electromagnetic clutch 2 connected with the electric motor 30 for controlling the transmission of the rotating force or torque thereof.

The electric motor 30 includes: a cylindrical yoke 3; four field permanent magnets 4 housed in and fixedly secured to the yoke 3 in an opposed relation with respect to each other; a shaft 7 rotatably supported by a first bearing 5 and a second bearing 6 in the yoke 3; an armature 8 fixedly mounted on the shaft 7; a commutator 9 having a plurality of segments 9*a* (see FIG. 10) fixed to the shaft 7 near one end thereof; a brush assembly 40 having brushes 32, which are urged into abutting engagement with a surface of the commutator 9 under the action of elastic forces of corresponding springs 10, and brush holders 31 holding the corresponding brushes 32, respectively; a housing 14 to which the brush holder 31 is fixedly attached through a magnetic shield plate 41, the housing being made of a non-magnetic material in the form of aluminum and connected with the yoke 3 by means of fastening screws 19, and a grommet 16 through which a line or conductor 15 extends. The magnetic shield plate 41 comprises a flat plate which is made, for example, by punching a rolled steel sheet of a thickness of 1 mm by press working to form a doughnut-shaped configuration.

The armature 8 is provided with a core 17 which has a plurality of slots extending in an axial direction, and a winding 18 which is formed of a conductor fitted in and wound around the slots of the core 17 in a plurality of turns.

The electromagnetic clutch 2 includes a clutch stator 20 fixed to the housing 14 by clutch fastening screws 21, a clutch coil 22 disposed in the clutch stator 20, a boss 23 rotatably mounted on one end of the shaft 7 through a third bearing 6*a*, a drive rotor 24 fixedly mounted on the shaft 7, and a doughnut-shaped disk 25 fixedly secured to the boss 23 through a spring member 26.

The brush assembly 40 includes a base 35 with a plurality of conductors 36 embedded therein by insert molding, four metal brush holders 31 fixed to the base 35, four brushes 32 held in the corresponding brush holders 31 and being urged to abut against the commutator 9 under the action of the elastic forces of the corresponding springs 10, and a plurality of lead wires 33 each having one end thereof connected with a corresponding brush 32 and the other end thereof connected with a connecting portion 34 of a corresponding conductor 36. The brushes 32 and the connecting portions 34 of the conductors 36 are arranged in line symmetry with respect to center lines A and B, which extend in diametrical directions passing through the center of the shaft 7, and which are perpendicular with respect to each other.

In the motorized power steering apparatus as constructed above, current is supplied to the winding 18 through the brushes 32 which are in abutment with the segments 9*a* of the commutator 9, so that the armature 8 is driven to rotate together with the shaft 7 under the action of an electromagnetic force.

On the other hand, by energizing the clutch coil 22, a magnetic circuit MC is formed by the clutch stator 20, the drive rotor 24 and the disk 25, all of which are made of magnetic materials. The spring member 26 is caused to flex or deform toward the clutch stator 20 under the action of the magnetic circuit MC thus formed, whereby the disk 25 is magnetically attracted and fixed to the drive rotor 24, which is thereby made integral with the boss 23.

Thus, the rotating force of the shaft 7 is transmitted to the drive rotor 24, which is fixed to the shaft 7, and thence to the boss 23, from which the rotating force is further transmitted to a warm shaft (not shown) splined with the boss 23, thereby assisting the steering force of a steering wheel of a vehicle (not shown).

FIG. 8 and FIG. 9 are explanatory views for explaining the conductivity orientation of each brush 32 of the brush assembly 40.

Electroconductive particles 41 (for instance, copper powder) contained in each brush 32 are turned into the powder particles (for instance, copper powder) deformed into tabular or flattened configurations in a direction perpendicular to the direction of pressing by a compressive stress generated upon press molding of each brush 32. Therefore, an orientation is created in the electroconductivity of each brush 32. A Z direction of each brush 32 in FIG. 9 is the direction of the press molding (i.e., pressing direction). The electric resistance of each brush 32 in the Z direction indicated by arrow Z exhibits a value greater than that in an X direction indicated by arrow X (i.e., in the direction of rotation of the shaft 7), or in a Y direction indicated by arrow Y (i.e., in a diametrical direction of the shaft 9). Generally, the ratio of the Z-direction resistance to the X-direction or Y-direction resistance is about 4 to 5.

FIG. 10 is a view illustrating the appearance in which a brush 32 press-molded in the Z direction is in abutment against the commutator 9. In this figure, the brush 32 is formed at its opposite edges with tapered contact portions 32*a* and 32*b* extending in parallel with the direction of rotation of the commutator 9, the tapered contact portions 32*a* and 32*b* being in abutment with the surface of a segment 9*a* of the commutator 9. A tip end of a lead wire 33 is embedded in the corresponding brush 32 in such a manner that it extends up to about the middle (i.e., half) of the length L of the brush 32.

In the brush assembly 40 of the above construction, when a comparison is made between current paths, indicated at arrows m0 and m2, respectively, passing through the brush 32 in FIG. 10, the current path indicated at arrow m2 is inclined in a direction of arrow Z in comparison with the current path indicated at arrow m0, and hence has an accordingly larger electric resistance, so that there takes place a greater temperature rise in the brush 32 when the electric motor 30 is energized. As a result, for example, the base 35 made of synthetic resin or plastic would be melted, causing a defective sliding of the brush 32.

Though in relatively infrequent cases such as, for example, when a car with the motorized power steering apparatus is put into a garage, large current is supplied to the electric motor 30 thereby to abnormally raise the temperature of the brush 32. Thus, there arises a problem in that certain measures have to be taken in order to prevent such situations. That is, for example, a maximum current to be supplied to the electric motor 30 or the time during which current is continuously supplied to the electric motor 30 is limited; or the sizes or dimensions of the respective component parts such as the brushes 32, etc., of the brush assembly 40 are enlarged in order to increase the thermal capacity and the effect of heat radiation.

SUMMARY OF THE INVENTION

The present invention is intended to obviate the problems as referred to above, and has for its object to provide a brush assembly in which electric power losses in brushes can be reduced to effectively suppress an abnormal rise in temperature of the brushes and hence the entire brush assembly.

Bearing the above object in mind, according to one aspect of the present invention, there is provided a brush assembly comprising: a brush having three or more tapered contact portions which are in contact with a surface of a commutator fixedly secured to a shaft; and a lead wire having a tip end portion thereof embedded in the brush. The brush is press-molded in a pressing direction perpendicular to a normal of the surface of the commutator. The contact portions of the brush are disposed at opposite edges of the brush in the pressing direction and at an intermediate portion between the opposite edges. The tip end portion of the lead wire is inserted into the brush in the pressing direction so as to extend up to a location or farther therefrom corresponding to a second one of the contact portions counted from a lead wire inserting side of the brush.

According to another aspect of the present invention, there is provided a brush assembly comprising: a brush having two tapered contact portions which are in contact with a surface of a commutator fixedly secured to a shaft; and a lead wire having a tip end portion thereof embedded in the brush. The brush is press-molded in a pressing direction perpendicular to a normal of the surface of the commutator. The contact portions of the brush are disposed at opposite edges of the brush in the pressing direction. The tip end portion of the lead wire is inserted into the brush in the pressing direction so as to extend over two thirds or more of the length of the brush in the pressing direction.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described in detail while referring to the accompanying drawings. The following description will be made with the same or like parts or elements as those in FIG. 6 to FIG. 10 being identified by the same symbols.

EMBODIMENT 1

Figure 1:
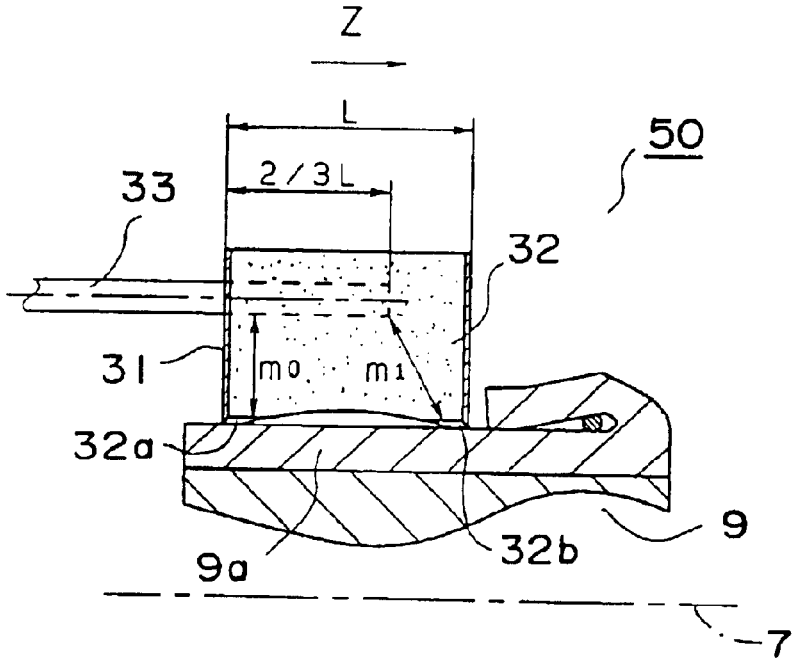
FIG. 1 is a cross sectional side view of essential portions of a brush assembly according to a first embodiment of the present invention.

FIG. 1 partially illustrates a brush assembly 50 constructed according to a first embodiment of the present invention. As shown in this figure, each of brushes 32 (only one is illustrated), which is press-molded in a Z direction as referred to above, i.e., along the axial direction of a shaft 7, is provided at its opposite edges with contact portions 32*a*, 32*b*, which are formed to taper toward their tips and extend in parallel with the direction of rotation of a commutator 9. These contact portions 32*a*, 32*b* are in abutting engagement or contact with the surface of one of segments 9*a* (only one is illustrated) of the commutator 9. A tip end portion of a lead wire 33 is embedded in the corresponding brush 32 so as to extend up to a depth of about two thirds of an axial length L thereof. The brush 32 is in partial contact with the commutator 9 and hence the sliding resistance of the brush 32 to the commutator 9 is small.

The brush 32 is formed of particles of graphite and a conductive material in the form of copper by means of press molding, and copper powder particles, fattened under pressure during press molding in a direction perpendicular to the direction of pressing, are contained at a rate of 30–70 weight percent of the entire brush in graphite powder particles similarly flattened under pressure in the direction perpendicular to the pressing direction. The lead wire 33 is connected with the brush 32 with its tip end portion being inserted into and embedded in the mixture of the graphite and copper powder particles at the time the brush 32 is formed by molding.

Figure 10:
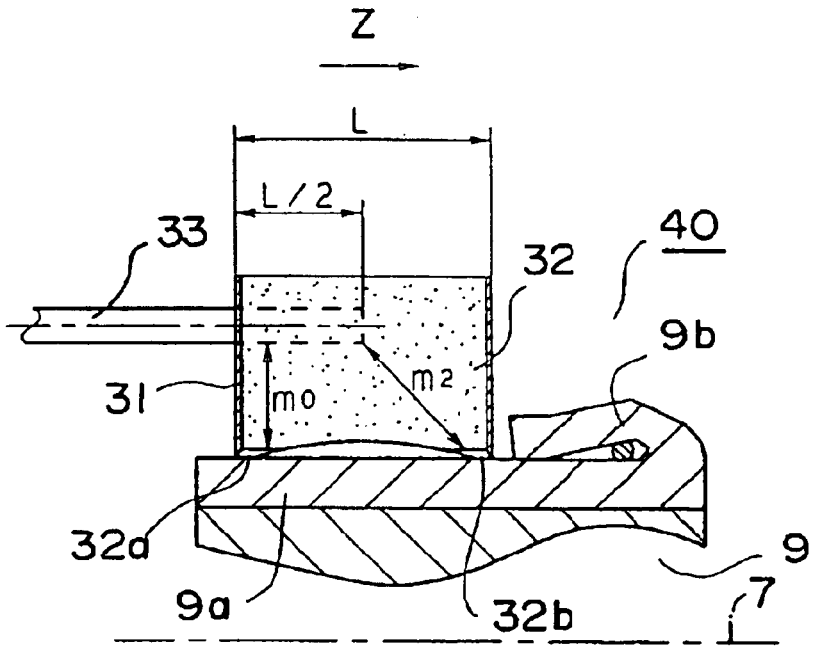
FIG. 10 PRIOR ART
FIG. 10 is a cross sectional side view of essential portions of the known brush assembly.

In this brush assembly 50, among current paths passing through the brush 32, a current path, indicated at arrow m1, through which current flows from the tip end of the lead wire 33 to the tapered end 32*b* of the brush 32 is more inclined to the Y direction (i.e., the horizontal or diametrical direction of the commutator 9) than the corresponding current path in the known brush assembly illustrated in FIG. 10. That is, the current path m1 or distance between the tip end of the lead wire 33 and the tapered end 32*b* of the brush 32 is shortened so that the resistance of the current path m1 becomes accordingly smaller due to the conductivity orientation of the brush 32.

Here, note that a symbol m0 in FIG. 1 and other figures designates a current path in a vertical direction with respect to the pressing direction of the brush 32 in the press molding.

Consequently, an electric power loss in the brush 32 is decreased, thus making it possible to suppress an abnormal or excessive rise in temperature of the brush 32. As a result, a deterioration in the surface of each segment 9*a* of the commutator 9 due to the heat of the brush 32 can be reduced, thereby increasing the output power of the electric motor 30 of the motorized power steering apparatus.

In addition, a maximum current to be supplied to the electric motor 30 can be increased in the present invention as compared with the electric motor 30 of the known motorized power steering apparatus, and the period of time for which current is continuously supplied to the motor 30 can be extended, whereby the performance of the electric motor 30, having been suppressed by the generation of heat therein in the known brush assembly, can be improved to a satisfactory extent.

Moreover, owing to reduction in the amount of heat generated by the brushes 32, it is possible to decrease the sizes or dimensions and the surface areas of the respective component parts including the brushes of the brush assembly 50. Such an effect is particularly great for the motorized power steering apparatus whose installation space is generally limited.

Further, the reduction in the dimensions of the brushes 32 serves to decrease not only operating noise thereof but also the size of the commutator 9, as a result of which the torque loss and the inertia of the electric motor 30 is reduced. Such effects are particularly remarkable in the motorized power steering apparatus.

Besides, since the lead wires 33 are inserted into the brushes 32 along the axial direction of the shaft 7, the brushes 32 are able to come in stable contact with the commutator 9, which is driven to rotate either clockwise or counterclockwise, irrespective of the direction of rotation thereof.

EMBODIMENT 2

Figure 2:
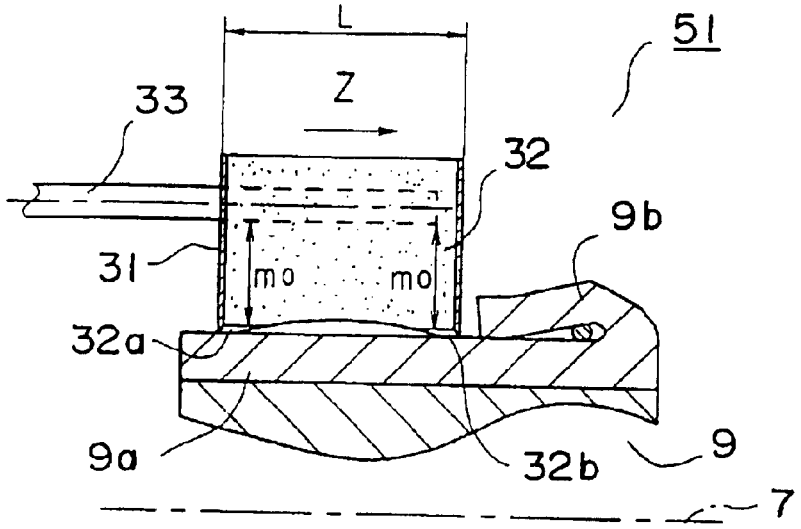
FIG. 2 is a cross sectional side view of essential portions of a brush assembly according to a second embodiment of the present invention.

FIG. 2 partially illustrates a brush assembly 51 constructed according to a second embodiment of the present invention. In this figure, a brush 32 press-molded in a direction indicated at arrow Z, i.e., in the axial direction of the shaft 7, is provided on its opposite edges with contact portions 32*a*, 32*b*, which are formed to taper toward the commutator 9. These contact portions 32*a*, 32*b* are in abutting engagement with the surface of a segment 9*a* of the commutator 9 during rotation of the shaft 9. A tip end of a lead wire 33 is embedded in a corresponding brush 32 in such a manner that it extends in parallel with the axis of the shaft 9 up to a location corresponding radially of the commutator 9 to the contact portion 32*b* near a hook or turnover portion 9*b* side of the commutator 9.

In this brush assembly 51, a current path, indicated at arrow m0, through which current flows in the brush 32 from the tip end of the lead wire 33 to the contact portion 32*b* of the brush 32 is in the above-mentioned Y direction in which the electric resistance of that current path is the smallest among various current paths therebetween. Therefore, the electric power loss in each brush 32 is further decreased as compared with the first embodiment.

EMBODIMENT 3

Figure 3:
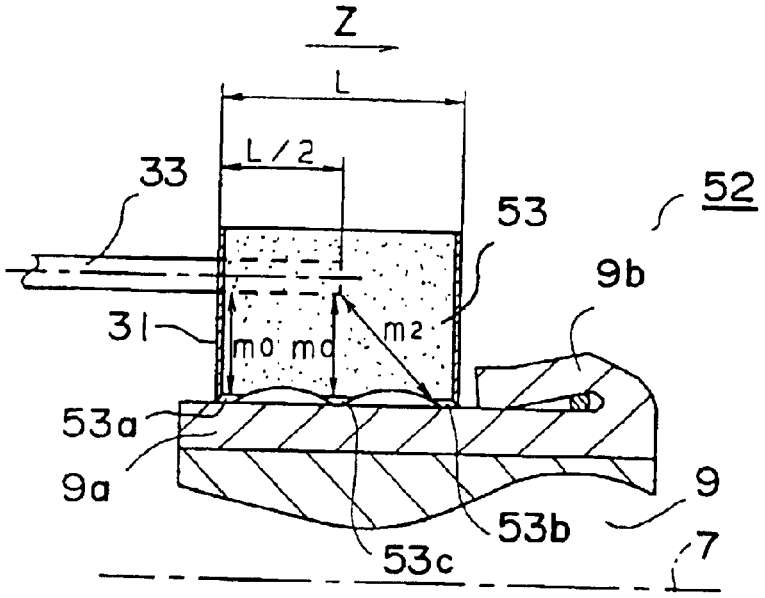
FIG. 3 is a cross sectional side view of essential portions of a brush assembly according to a third embodiment of the present invention.

FIG. 3 partially illustrates a brush assembly 52 constructed according to a third embodiment of the present invention. In this figure, a brush 53 press-molded in a direction indicated at Z, i.e., in the axial direction of the shaft 7, is provided at its opposite edges and at an intermediate portion therebetween with contact portions 53*a*, 53*b* and 53*c*, respectively, which are formed to taper toward a commutator 9. These contact portions 53*a*, 53*b* and 53*c* is in abutting engagement with the surface of a segment 9*a* of the commutator 9. A tip end of a lead wire 33 is embedded in a corresponding brush 53 in such a manner that it extends up to a location corresponding radially of the commutator 9 to the intermediate contact portion 53*c*.

In this brush assembly 52, most of currents flowing in the brush 53 from the tip end of the lead wire 33 to the contact portions 53*a*, 53*b* and 53*c* pass through a current path indicated at arrow m0 among various current paths in the brush 53. The direction of that current path is the above-mentioned direction of Y in which the electric resistance is the smallest among the various current paths, so the electric power loss in the brush 53 is decreased as compared with the first embodiment.

EMBODIMENT 4

Figure 4:
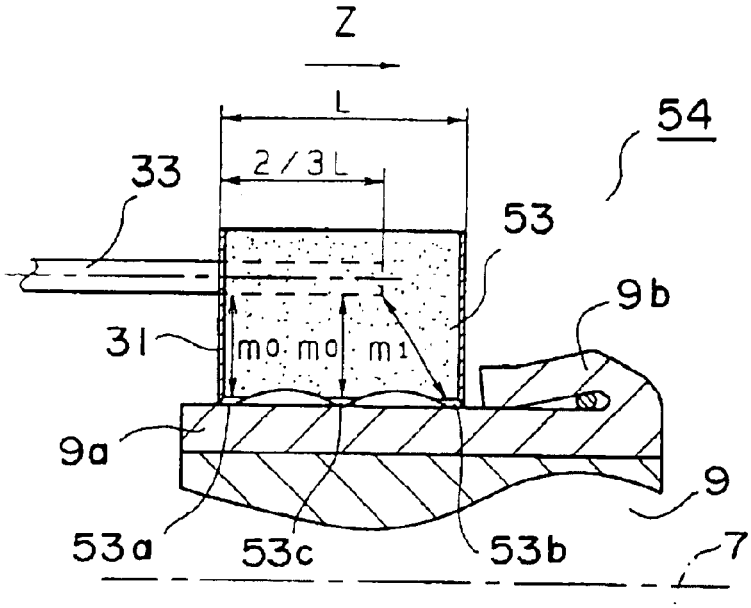
FIG. 4 is a cross sectional side view of essential portions of a brush assembly according to a fourth embodiment of the present invention.

FIG. 4 partially illustrates a brush assembly 54 constructed according to a fourth embodiment of the present invention. In this figure, a brush 53 press-molded in a direction indicated at Z, i.e., in the axial direction of a shaft 7, is provided at its opposite edges and at an intermediate portion therebetween with contact portions 53*a*, 53*b* and 53*c*, respectively, which are formed to taper toward a commutator 9. These contact portions 53*a*, 53*b* and 53*c* are in abutting engagement with the surface of a segment 9*a* of the commutator 9. A tip end of a lead wire 33 is embedded in the brush 53 in such a manner that it extends over about two thirds of the axial length L of the brush 53 from its near side.

In this brush assembly 54, a current path, indicated at arrow m1, through which current flows in the brush 53 from the tip end of the lead wire 33 to the contact portion 53*b* at a far side of the brush 53, is more inclined toward the above-mentioned Y direction, and hence has a smaller electric resistance as compared with the third embodiment. Therefore, an electric power loss in the brush 53 is further decreased as compared with the third embodiment.

EMBODIMENT 5

Figure 5:
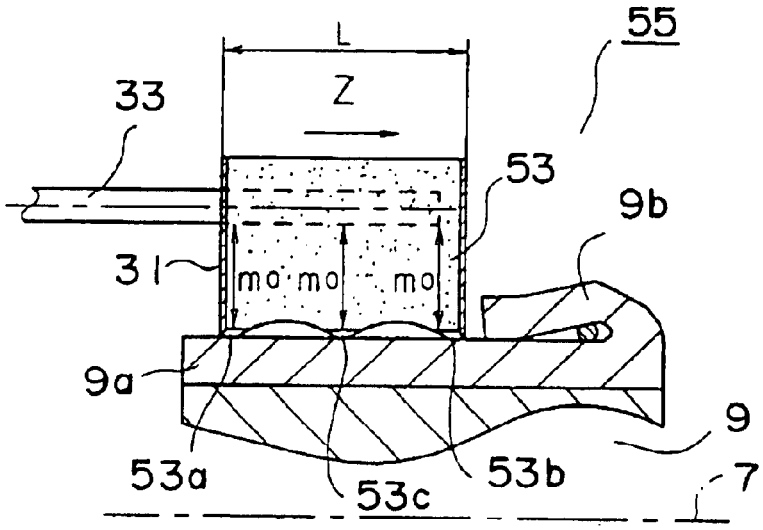
FIG. 5 is a cross sectional side view of essential portions of a brush assembly according to a fifth embodiment of the present invention.
Figure 6:
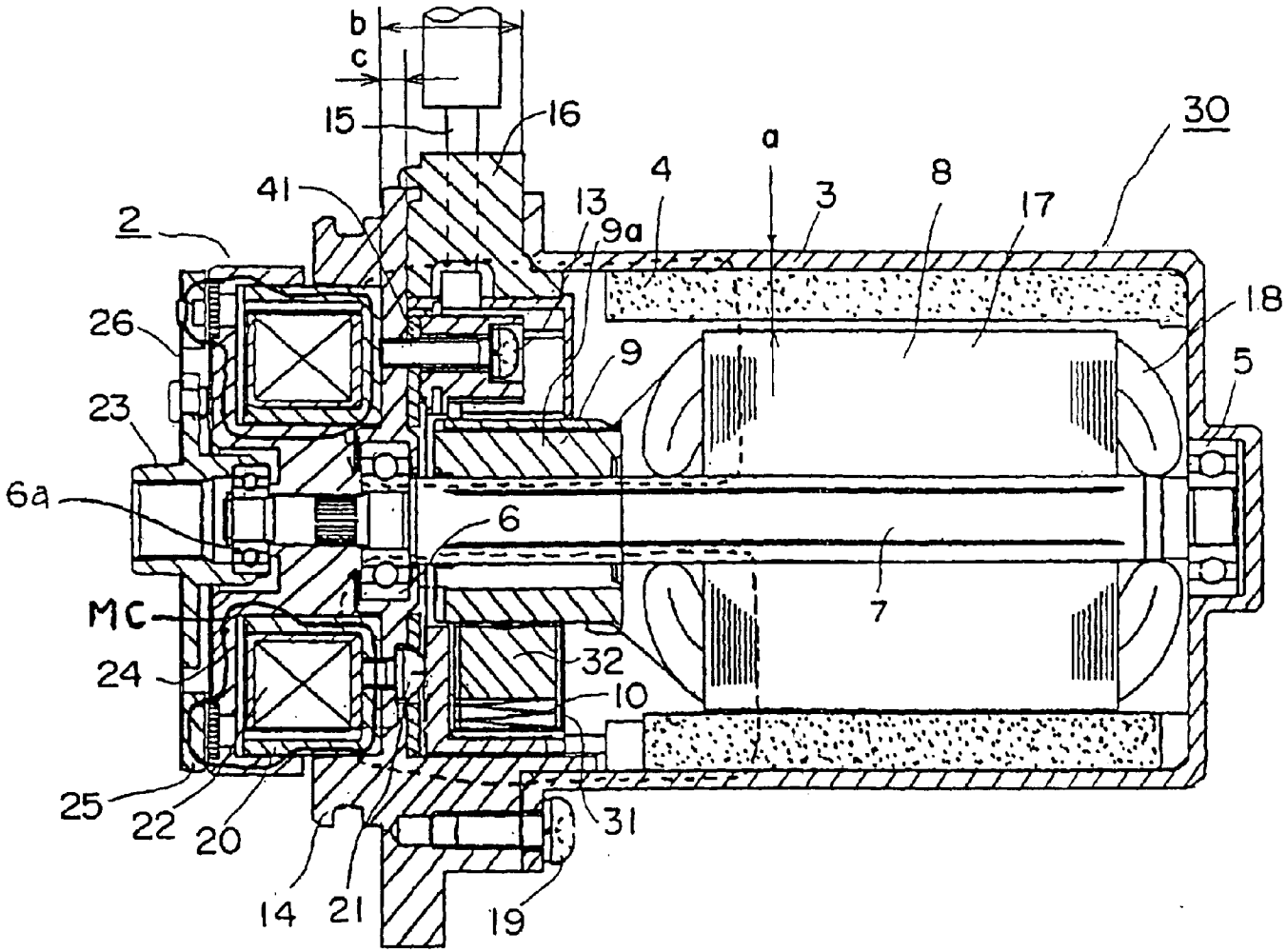
FIG. 6 PRIOR ART
FIG. 6 is a cross sectional side view of a known motorized power steering apparatus.
Figure 7:
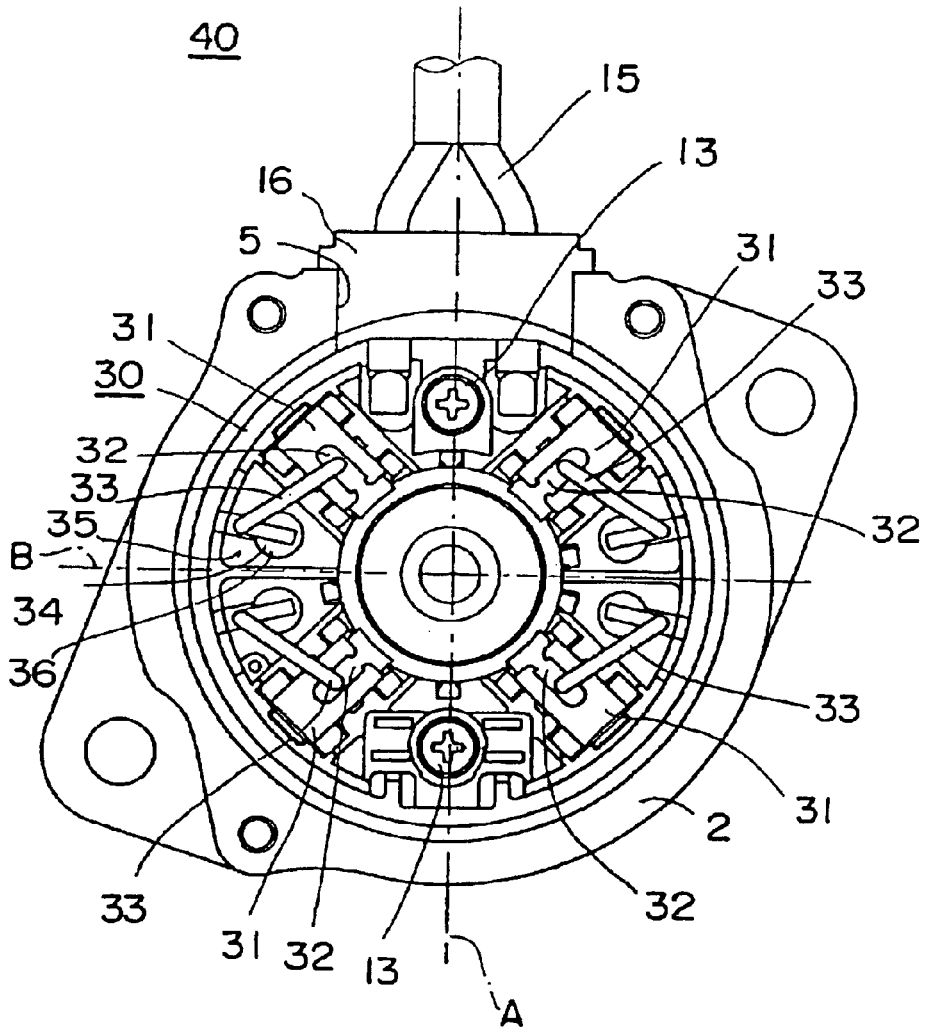
FIG. 7 PRIOR ART
FIG. 7 is a front elevation of the brush assembly of FIG. 6.
Figure 8:
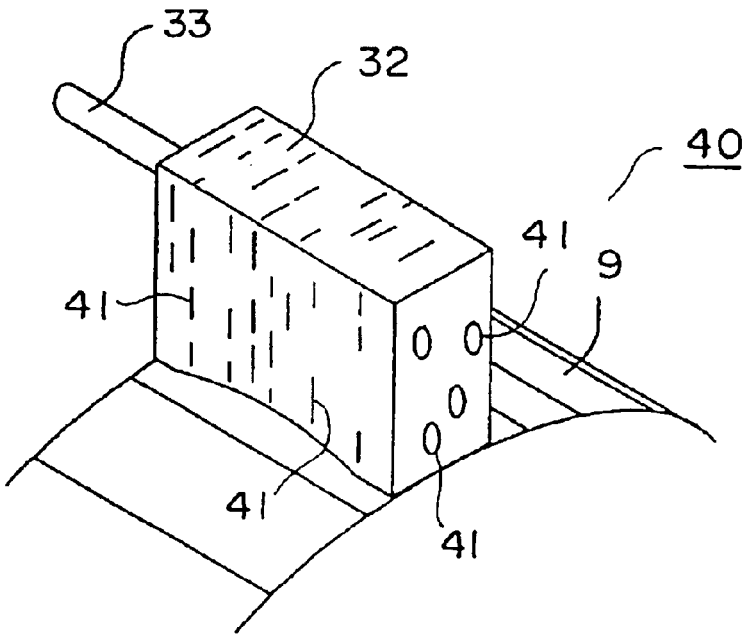
FIG. 8 PRIOR ART
FIG. 8 is a view for explaining the conductivity orientation of a brush of the known brush assembly.
Figure 9:
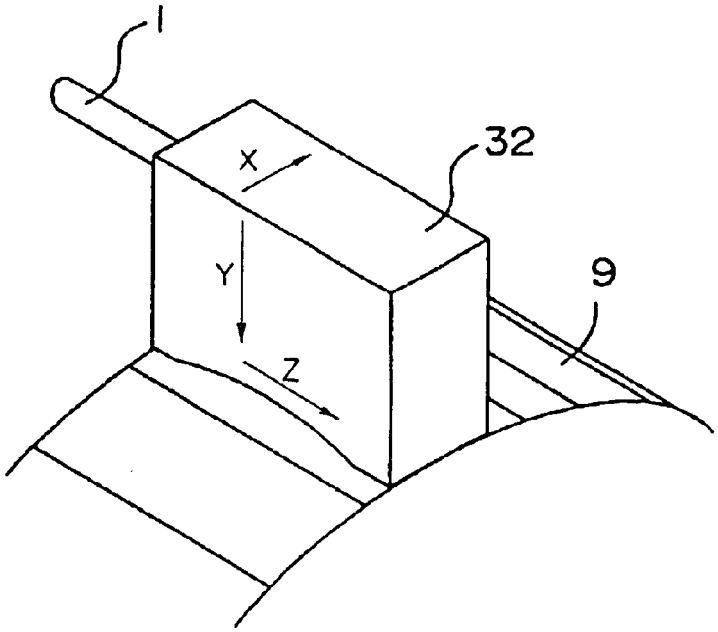
FIG. 9 PRIOR ART
FIG. 9 is another view for explaining the conductivity orientation of the brush.

FIG. 5 partially illustrates a brush assembly 55 constructed according to a fifth embodiment of the present invention. In this figure, a brush 53 is in abutting engagement with the surface of a segment 9*a* of a commutator 9 at three locations, i.e., at opposite edges 53*a*, 53*b* and at an intermediate portion 53*c* therebetween of the brush 53. In addition, a tip end of a lead wire 33 is embedded in the brush 53 in such a manner that it extends up to a location corresponding radially of the shaft 7 to the contact portion 53*b* of the brush 53 at its far side.

The current flowing in the brush 53 from the tip end of the lead wire 33 to the contact portions passes through a current path indicated at arrow m0 among various current paths in the brush 53. The direction of this current path is the above-mentioned Y direction in which the electric resistance is the smallest, and hence the electric power loss in the brush 53 of this embodiment is further decreased as compared with the aforementioned fourth embodiment.

Although a brush assembly incorporated in an electric motor of a motorized power steering apparatus has been shown and described in the above-mentioned respective embodiments, the present invention can of course be applied to any type of motor with a commutator in which electric power is supplied from a power supply to the commutator through a brush.

In addition, the number of tapered contact portions of each brush formed to extend in parallel with the direction of rotation of a commutator is not limited to two or three as illustrated, but instead may be four or more.

Further, although in the above-mentioned respective embodiments, the contact portions of the brushes are in contact with the peripheral surface of the cylindrical-shaped commutator 9, the present invention can be applied to such a brush assembly in which a commutator fixedly secured to a shaft is of a disk-shaped configuration with contact portions of brushes being in contact with one side surface of the disk-shaped commutator.

As described in the foregoing, the present invention provides the following advantages.

According to a brush assembly of one aspect of the present invention, a tip end portion of a lead wire is inserted into a brush in a pressing direction so as to extend up to a location or farther therefrom corresponding to a second one of three or more contact portions counted from a lead wire inserting side of the brush. With this arrangement, an electric power loss in the brush is decreased, and an abnormal rise in temperature of the brush can be suppressed. As a result, deterioration of the commutator by the heat generated in the brush can be decreased. In addition, the respective sizes or dimensions and the surface areas of the component elements of the brush assembly including the brush can be minimized due to reduction in the amount of heat generated from the brush. Moreover, the reduced size of the brush serves to decrease sliding noise of the brush as well as the size of a commutator.

According to a brush assembly of another aspect of the present invention, a tip end portion of a lead wire is inserted into a brush in a pressing direction so as to extend over two thirds or more of the length of the brush in the pressing direction. With this arrangement, it is possible not only to decrease an electric power loss in the brush but also to suppress an abnormal rise in temperature of the brush, as a consequence of which deterioration of the commutator by the heat generated in the brush can be decreased. Moreover, reduction in the amount of heat generated from the brush serves to decrease the respective sizes or dimensions and the surface areas of the component elements of the brush assembly including the brush. Additionally, due to the reduction in size of the brush, it is possible to decrease sliding noise of the brush and the size of a commutator as well.

In a preferred form of the invention, the tip end portion of the lead wire is inserted into and fixedly connected with the brush when the brush is press-molded. Thus, the lead wire can be connected with and fixedly secured to the brush easily and strongly, In another preferred form of the invention, the brush contains flattened graphite, so that the electroconductivity orientation of the brush becomes stronger, thereby decreasing the electric resistance of the brush in a direction perpendicular to the pressing direction.

In a further preferred form of the invention, the brush contains an amount of copper in the range of from 30 to 70 weight percent. Thus, such trouble will hardly arise or can be avoided that too small an amount of copper results in too large electric resistance or too great an amount of copper damages those portions of the brush which are in contact with the commutator.

In a still further preferred embodiment of the invention, the lead wire is inserted into the brush in an axial direction of a shaft, so that the brush comes in stable contact with the commutator without being influenced by the rotational direction of the commutator, thus providing excellent brush characteristics.

In a yet further preferred embodiment of the invention, the brush is incorporated into an electric motor of a motorized power steering apparatus. In this case, the brush assembly of the present invention is suitable and useful for the motorized power steering apparatus which requires high performance such as quiet operation as well as miniaturization because of a limited installation space available.

While the invention has been described in terms of preferred embodiments, those skilled in the art will recognize that the invention can be practiced with modifications within the spirit and scope of the appended claims.

What is claimed is:

1. A brush assembly comprising:

a brush having only three contact portions which are in contact with a surface of a commutator fixedly secured to a shaft; and a lead wire having a tip end portion thereof embedded in said brush;

wherein said brush is press-molded in a pressing direction perpendicular to a normal of the surface of said commutator, and two of the three contact portions of said brush are disposed at opposite edges of said brush in said pressing direction and a third one of the three contact portions is disposed at an intermediate portion between said opposite edges, said third one of the three contact portions being substantially equal distance from each of the other two contact portions, and the tip end portion of said lead wire is inserted into said brush in said pressing direction so as to extend up to a location or farther therefrom corresponding to a second one of said contact portions counted from a lead wire inserting side of said brush.

2. The brush assembly to claim 1, wherein the tip end portion of said lead wire is inserted into and fixedly connected with said brush when said brush is press-molded.

3. The brush assembly according to claim 1, wherein said brush contains flattened graphite.

4. The brush assembly according to claim 1, wherein said brush contains an amount of copper in the range of from 30 to 70 weight percent.

5. The brush assembly according to claim 1, wherein said lead wire is inserted into said brush in an axial direction of said shaft.

6. The brush assembly according to claim 1, wherein said brush is incorporated into an electric motor of a motorized power steering apparatus.

7. A brush assembly comprising:

a brush having only three tapered contact portions which are in contact with a surface of a commutator connected to a shaft; and a lead wire having a tip end portion thereof embedded in said brush;

wherein said brush is press-molded in a pressing direction perpendicular to a normal of the surface of said commutator, and two of the three contact portions of said brush are disposed at opposite edges of said brush in said pressing direction and a third one of said three contact portions is disposed at an intermediate portion between said opposite edges, said third one of said three contact portions being substantially equal distance from each of said other two contact portions, and the tip end portion of said lead wire is inserted into said brush in said pressing direction so as to extend at least up to a location corresponding to a second one of said contact portions.

* * * * *